US007530681B2

(12) United States Patent
Tajima

(10) Patent No.: US 7,530,681 B2
(45) Date of Patent: May 12, 2009

(54) INK JET PRINT HEAD

(75) Inventor: Hiroki Tajima, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 497 days.

(21) Appl. No.: 11/411,811

(22) Filed: Apr. 27, 2006

(65) Prior Publication Data

US 2006/0244797 A1 Nov. 2, 2006

(30) Foreign Application Priority Data

Apr. 28, 2005 (JP) ..... 2005-132316
Feb. 22, 2006 (JP) ..... 2006-045786

(51) Int. Cl.
*B41J 2/175* (2006.01)
*B41J 2/45* (2006.01)

(52) U.S. Cl. ..... 347/87; 347/66

(58) Field of Classification Search ..... 347/65, 347/66, 87

See application file for complete search history.

(56) References Cited

U.S. PATENT DOCUMENTS 4,872,027 A 10/1989 Buskirk et al.
5,361,087 A 11/1994 Tajima et al.
5,489,930 A * 2/1996 Anderson ..... 347/71
5,748,213 A 5/1998 Karita et al.
5,826,333 A 10/1998 Iketani et al.
5,867,200 A 2/1999 Tajima et al.
5,983,471 A * 11/1999 Osawa ..... 29/25.35
6,290,340 B1 * 9/2001 Kitahara et al. ..... 347/70
6,328,429 B1 12/2001 Tajima et al.
6,331,051 B1 12/2001 Tajima et al.
6,406,137 B1 6/2002 Okazaki et al.
6,499,828 B1 12/2002 Iketani et al.
6,540,343 B1 4/2003 Umeyama et al.
6,584,687 B1 * 7/2003 Yamamoto et al. ..... 29/890.1
6,631,966 B2 10/2003 Watanabe et al.
6,799,841 B2 10/2004 Goto et al.
6,953,243 B2 10/2005 Umeyama et al.
6,975,466 B2 12/2005 Umeyama et al.
2001/0043247 A1 11/2001 Tajima et al.
2002/0012021 A1 1/2002 Umeyama et al.
2002/0118242 A1 8/2002 Tajima et al.

* cited by examiner

*Primary Examiner*—Anh T. N. Vo
(74) *Attorney, Agent, or Firm*—Fitzpatrick, Cella, Harper & Scinto

(57) ABSTRACT

An ink jet print head is provided which is highly reliable in recovering its performance by removing bubbles accumulated in the ink paths to reliably prevent print quality degradations in bi-directional printing. In the ink ejection member having an odd number of arrayed ink supply ports to supply ink to the ejection openings, the ink colors of the ink supply ports are arranged laterally symmetrically and a plurality of ink tanks are arranged side by side so that the direction of array of the ink supply ports is perpendicular to the direction of array of the ink tanks.

2 Claims, 11 Drawing Sheets

INK JET PRINT HEAD

BACKGROUND OF THE INVENTION

1. Field of the Invention

The present invention relates to an ink jet print head that ejects ink onto a print medium to form an image on it.

2. Description of the Related Art

FIG. 9 to FIG. 11 show a construction of a conventional ink jet print head. FIG. 9 and FIG. 10 are perspective views of the entire ink jet print head as seen from an electric wiring member side and from an ink ejection member side, respectively. FIG. 11 is a front view of the print head as seen from the ink ejection member side, penetratively showing ink paths and ink supply ports.

As shown in FIG. 9 and FIG. 10, an ink jet print head 200 comprises an ink supply member 201, a flow path plate 202, an ink ejection member 203 and an electric wiring member 204 all formed integral as one body. On the ink supply member 201 are removably mounted a first ink tank 206*a*, a second ink tank 206*b* and a third in tank 206*c*.

On the ink ejection member 203 is arranged an orifice plate (not shown) formed with a plurality of ejection opening columns to eject ink as ejection energy generation elements such as electrothermal transducers are driven. The ink ejection member 203 is provided with a plurality of ink supply ports (five ports in the example shown) one for each of the ejection opening columns. The individual ejection energy generation elements are supplied a drive signal through contact pads 204*a* of the electric wiring member 204 that are in contact with a connector (not shown) on the printing apparatus side.

As shown in FIG. 11, the five ink supply ports 203*a*, 203*b*, 203*c*, 203*d* and 203*e*provided in the ink ejection member 203 are arranged so that their direction of array is parallel to that of the first, second and third ink tanks 206*a*, 206*b* and 206*c*. The flow path plate 202 is formed with ink paths to supply ink from ink introduction holes of the ink tanks to the respective ink supply ports. An ink path 201*d* running from an ink introduction hole 201*a* of the first ink tank 206*a* connects to two ink supply ports 203*a* and 203*e* situated at the ends, in the array direction, of the group of the ink supply ports. An ink path 201*e* running from an ink introduction hole 201*b* of the second ink tank 206*b* connects to two ink supply ports 203*b* and 203*d* situated on both sides of the center ink supply port 203*c*. Further, an ink path 201*f* running from an ink introduction hole 201*c* of the third ink tank 206*c* connects to the center ink supply port 203*c*. Thus, the five ink supply ports 203*a*, 203*b*, 203*c*, 203*d*, 203*e* are supplied, from one end of the port group in the array direction, first color, second color, third color, second color and first color in a symmetrical color order.

As described above, the ink jet print head 200 of the above construction has five ink supply ports and five ejection opening columns in the ink ejection member 203 arranged in a symmetrical order of colors although there are only three color ink tanks. Therefore, when the print head is mounted on a carriage of the ink jet printing apparatus for reciprocal printing on a print medium, the same color ink application order can be realized for both a first main scan in a forward direction and a second main scan in a backward direction. This suppresses color deviations assuring a good print quality. That is, this control of the reciprocal printing operation can not only increase the printing speed but also enhance the print quality.

In the construction of the ink jet print head described above, five ejection opening columns are used although there are only three color inks. It is therefore necessary to arrange the ink paths to the individual ink supply ports so that they do not cross each other in a plane while minimizing the number of ink tanks (three). When penetratively viewed from the ink supply port side, the ink paths of other colors overlap some of the ink supply ports, as shown in FIG. 11.

Therefore, the ink paths are narrow and complex, and communication portions between the ink paths and the ink supply ports are limited by the ink paths of other colors and thus inevitably become relatively small holes.

In such an ink path construction, there is little problem in supplying ink from the ink tanks to the ink ejection member. However, if an ink jet printer is left unused for a long period of time, air dissolved in ink may become separated from the ink or external air may enter penetrating through the flow path plate 202 that forms the ink paths. In that case, bubbles may accumulate in the ink paths of the ink jet print head and are not easy to draw out from the narrow, complicated ink paths.

Generally, the ink jet printing apparatus is provided with means for processing to recover or maintain an ink ejection performance of the ink jet print head. One such example is means for performing a suction-based recovery operation, which involves capping a surface of the print head formed with ink ejection openings and, in the capped state, applying a negative pressure to the ejection openings to forcibly discharge ink from ink paths inside the ejection openings. If the ink paths are narrow and complex as described above, the control of the suction pressure and suction time during the suction-based recovery operation requires precise adjustments.

SUMMARY OF THE INVENTION

An object of the present invention is to provide a construction that uses a plurality of ejection opening columns and ink introduction holes smaller in number than the ejection opening columns, and which simplifies the shape of the ink paths running from the ink tanks to the ejection opening columns. Accordingly, there is provided an ink jet print head which is little affected by the accumulation of bubbles or which can easily remove bubbles by a simple recovery function.

Another object of the present invention is to provide an ink jet print head comprising: a plurality of ejection opening columns which can be supplied ink from a plurality of ink storage portions and which is larger in number than the ink storage portions, wherein at least two of the ejection opening columns that do not adjoin each other in a direction of array can be supplied ink from at least one of the ink storage portions; an ink ejection member having the plurality of ejection opening columns and a plurality of ink supply ports, the ink supply ports being arrayed in a one-to-one correspondence with the ejection opening columns to supply ink to the associated ejection opening columns; and a flow path forming member mounted on a surface of the ink ejection member opposite the surface on which the plurality of ejection opening columns are installed, the flow path forming member being formed with ink introduction holes to introduce ink from the plurality of ink storage portions and with ink paths to communicate the ink introduction holes to the ink supply ports; wherein the plurality of ink introduction holes in the flow path forming member and the plurality of ink supply ports in the ink ejection member are arranged to cross each other three-dimensionally; wherein the ink paths connecting the ink introduction holes and the corresponding ink supply ports are formed so as not to overlap the other ink supply ports.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, preferred embodiments of this invention will be described by referring to the accompanying drawings.

First Embodiment

Figure 1:
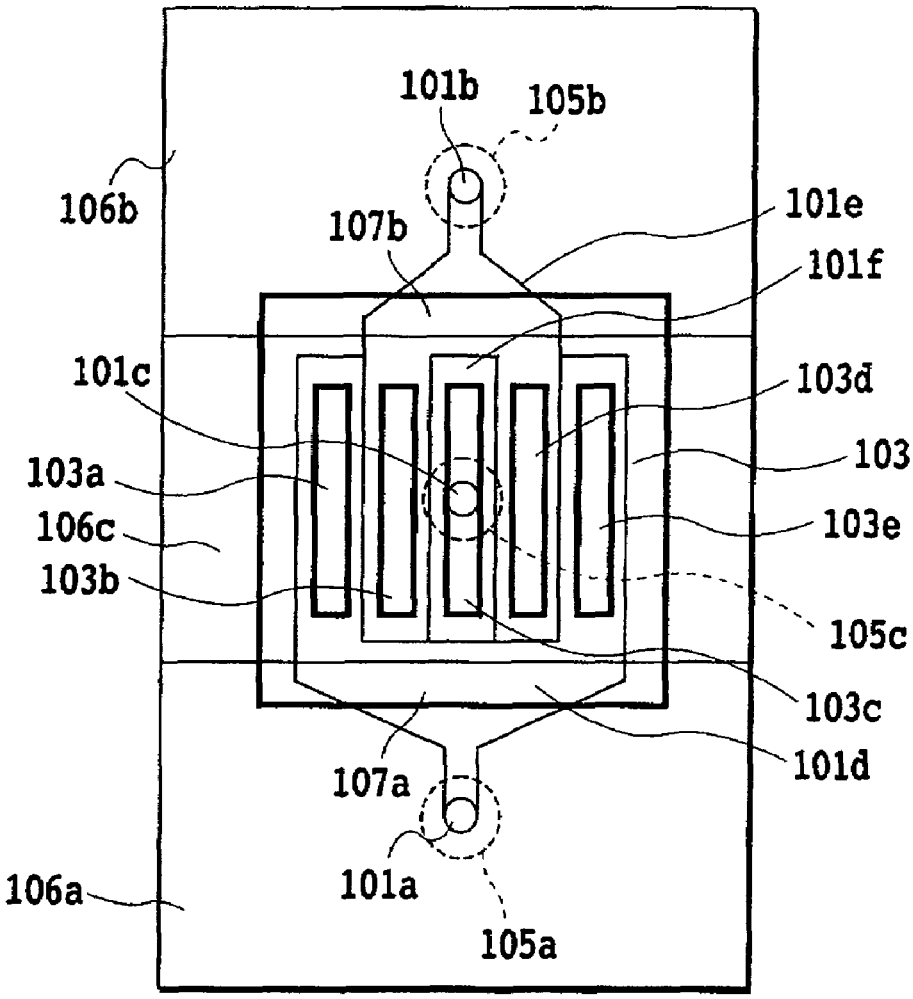
FIG. 1 is a front view of an ink jet print head of a first embodiment of this invention as viewed from an ink ejection member side.
Figure 2:
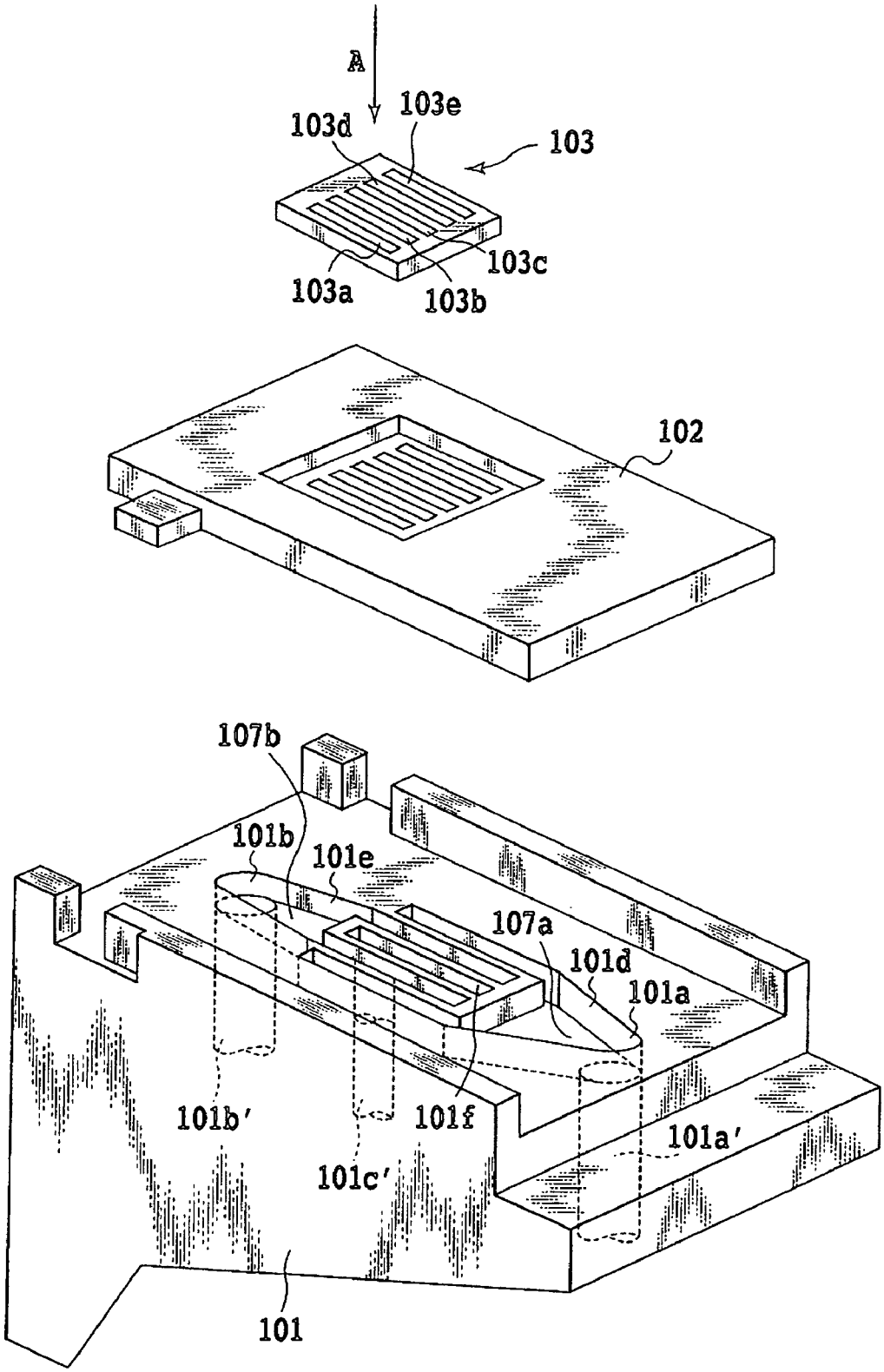
FIG. 2 is an exploded perspective view of essential portions of the ink jet print head of the first embodiment of this invention.

FIG. 1 to FIG. 5 show an ink jet print head as one embodiment of this invention. FIG. 1 is a front view of the ink jet print head of the first embodiment of this invention, as seen from the ink ejection member side (in a direction of arrow A of FIG. 2), and schematically and penetratively shows ink paths and ink supply ports. FIG. 2 is an exploded perspective view of the ink jet print head of the first embodiment, showing the configuration of the ink paths.

Figure 3:
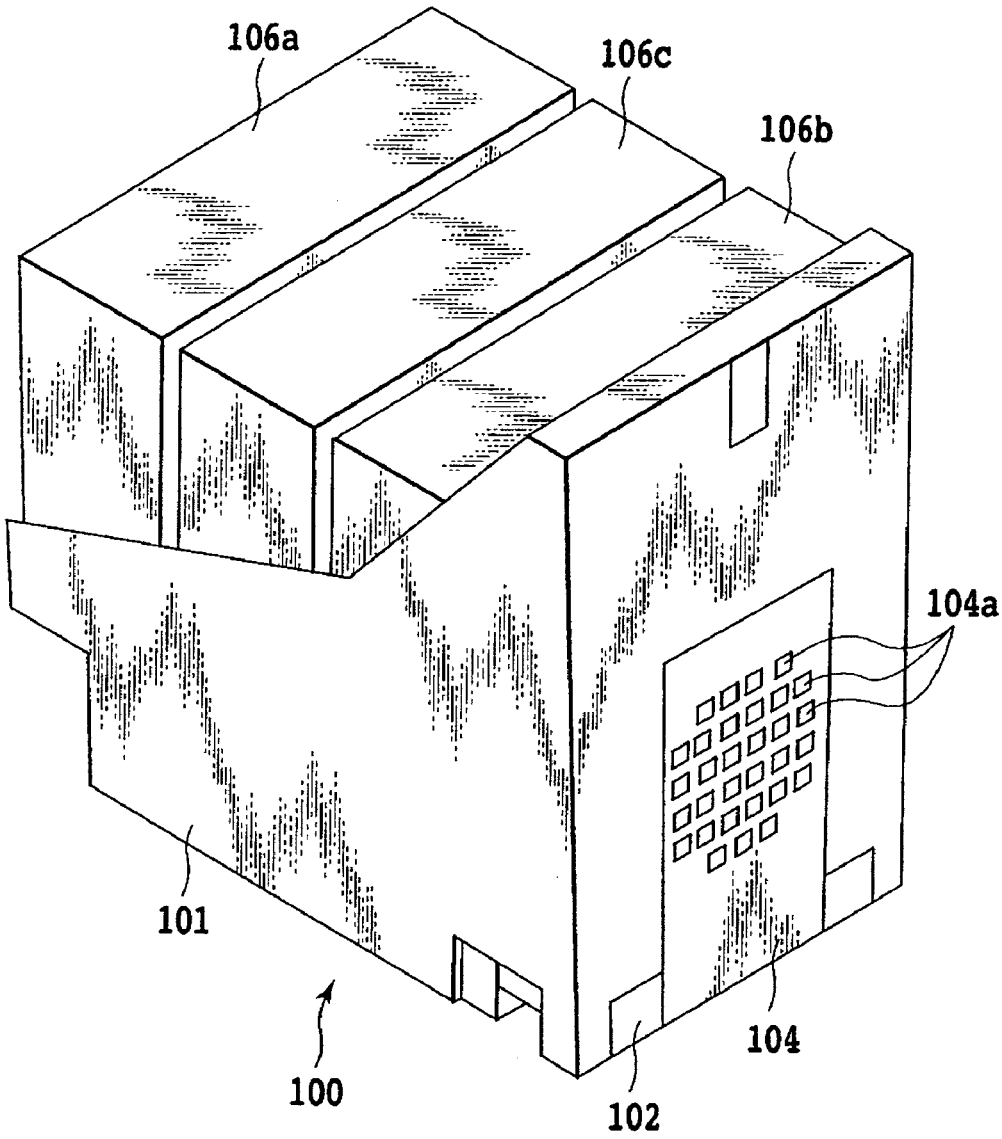
FIG. 3 is a perspective view of the whole ink jet print head of the first embodiment as viewed from an electric wiring member side.
Figure 4:
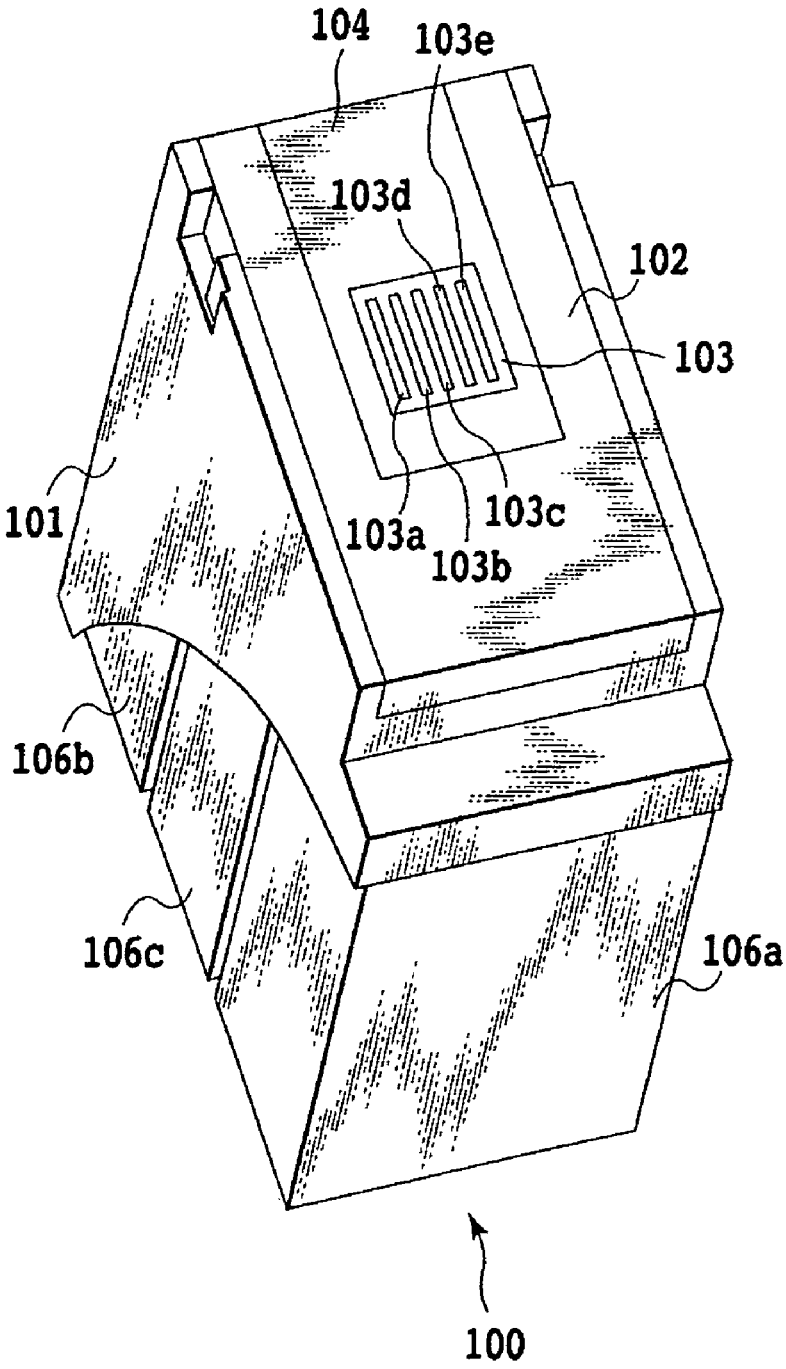
FIG. 4 is a perspective view of the whole ink jet print head of the first embodiment as viewed from an ink ejection member side.
Figure 5:
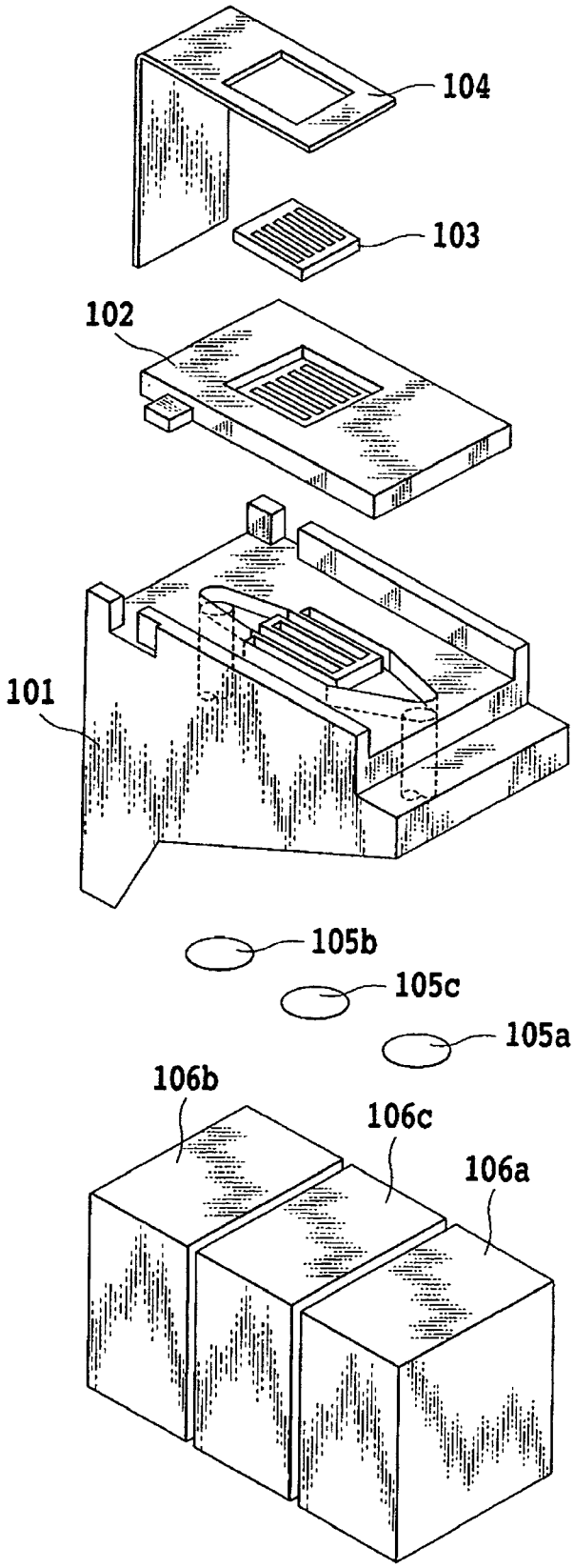
FIG. 5 is an exploded perspective view of the whole ink jet print head of the first embodiment of this invention.

FIG. 3 and FIG. 4 are perspective views of the entire ink jet print head of the first embodiment as seen from the electric wiring member side and from the ink ejection member side, respectively. FIG. 5 is an exploded perspective view of the entire ink jet print head.

As shown in FIG. 3 to FIG. 5, an ink jet print head 100 comprises an ink supply member 101, a flow path plate 102, an ink ejection member 103 and an electric wiring member 104, all formed integral as one body. The ink supply member 101 is welded with first to third filters 105*a*, 105*b*, 105*c*. A first ink tank 106*a*, a second ink tank 106*b* and a third ink tank 106*c* are removably mounted on the ink supply member 101.

On the ink ejection member 103 is mounted an orifice plate (not shown) formed with a plurality of ejection opening columns to eject ink as ejection energy generation elements such as electrothermal transducers are driven. The ink ejection member 103 is provided with a plurality of ink supply ports (five ports in the example shown) one for each of the ejection opening columns. The individual ejection energy generation elements are supplied a drive signal through contact pads 104*a* of the electric wiring member 104 that are in contact with a connector (not shown) on the printing apparatus side.

Unlike the above conventional example, this embodiment, as shown in FIG. 1, has five ink supply ports 103*a*, 103*b*, 103*c*, 103*d*, 103*e* formed in the ink ejection member 103 such that their direction of array is perpendicular to that of the first, second and third ink tank 106*a*, 106*b*, 106*c*. Therefore, ink introduction holes 101*a*, 101*b*, 101*c* communicating with the ink tanks 106*a*, 106*b*, 106*c* are arrayed in a direction perpendicular to the direction of array of the ink supply ports 103*a*-103*e*. The ink introduction holes 101*a* and 101*b* are situated on different sides of the ink ejection member 103 in the hole array direction. Further, the ink introduction hole 101*c* overlaps the ink ejection member 103, especially the center ink supply port 103*c*.

With the above construction and arrangement, as is seen from FIG. 1, the ink introduction holes 101*a*, 101*b*, 101*c* overlap the bottom surfaces of the ink tanks 106*a*, 106*b*, 106*c* mounted on the ink supply member 101, respectively. As a result, ink introduction paths 101*a'*, 101*b'*, 101*c'* can be linearly extended, without being curved, from the ink introduction holes at their one end to the ink tank connections at their other end, as can be seen from FIG. 5 and FIG. 8.

The ink introduction hole 101*a* opens into an ink distribution chamber 107*a* formed in the ink supply member 101. Ink paths 101*d* and 101*e* denote whole paths connecting the ink introduction holes 101*a* and 101*b* and the corresponding ink supply ports. The ink distribution chamber 107*a* is branched laterally symmetrically into two first ink paths 101*d*. The branched paths 101*d* extend along the length of the outermost ejection opening columns and overlappingly communicate with the ink supply ports 103*a*, 103*e*, respectively, that are situated at the ends of the ejection opening column group in the ejection opening column array direction. Similarly, the ink introduction hole 101*b* opens into an ink distribution chamber 107*b* which is branched laterally symmetrically into two second ink paths 101*e*. The branched paths 101*e* overlappingly communicate with the ink supply ports 103*b*, 103*d*, respectively, that are situated on both sides of the center ink supply port 103*c*. A third ink path 101*f* coming from the ink introduction hole 101*c* overlappingly communicates with the center ink supply port 103*c*. So, the five ink supply ports 103*a*, 103*b*, 103*c*, 103*d*, 103*e* provided in the ink ejection member 103 correspond to first color, second color, third color, second color and first color, respectively.

Figure 11:
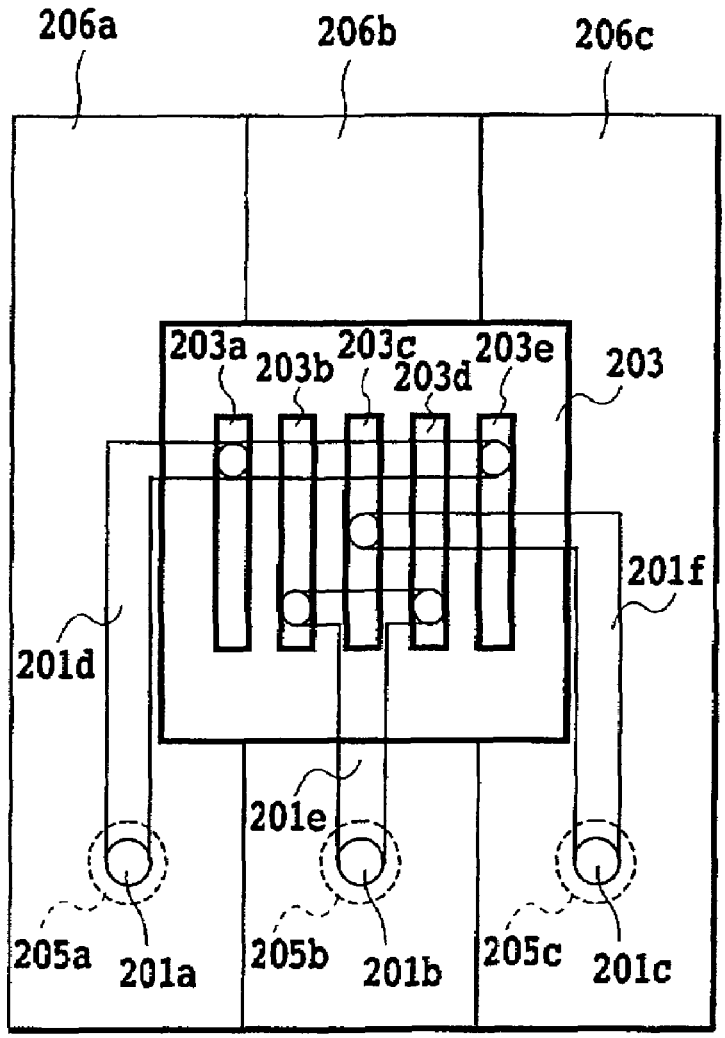
FIG. 11 is a front view of the conventional ink jet print head as seen from the ink ejection member side.

In this embodiment, unlike the conventional example shown in FIG. 11, each of the ink supply ports can be connected with the associated color ink path without having other color ink paths cross the ink supply port of interest. The ink paths therefore can have a simpler structure, making it difficult for bubbles to accumulate or stay in the ink paths. If the bubbles accumulate, they can easily be removed by the suction-based recovery operation. This in turn alleviates the control conditions required of the suction-based recovery operation.

As shown in FIG. 1, when seen through from ink ejection member 103 side, the relation among the ink supply ports in the ink ejection member 103, the openings in the flow path plate 102 and the ink paths in the ink supply member 101 is such that the area of each opening formed in the flow path plate 102 is larger than that of each ink supply port 103*a*, 103*b*, 103*c*, 103*d*, 103*e* formed in the ink ejection member 103. Further, the area of each of the ink paths (branched paths)

in the ink supply member 101 is larger than the area of each overlapping opening in the flow path plate 102. That is, the cross-sectional area of the flow path increases toward the upstream of the ink supply route. So, the ink supply routes through which the inks flow from the ink paths 101*d*, 101*e*, 101*f* to the ink ejection member do not have a partly narrow or throttled portion. The inks supplied from the ink tanks can be accumulated in the ink distribution chambers 107*a*, 107*b* formed in the ink paths 101*d*, 101*e* before being further supplied to the branched paths These ensure that the inks can be supplied stably and uniformly to the ink supply ports in the ink ejection member 103 and to all ejection opening columns and that bubbles do not easily accumulate in the upstream portions of the ink supply routes and, if they accumulate, can easily be removed by the suction-based recovery operation. It should be noted that why the area of the individual openings formed in the flow path plate 102 can be made larger than that of the individual ink supply ports 103*a*, 103*b*, 103*c*, 103*d*, 103*e* is because the size and position of the communication portions between the ink paths and the associated ink supply ports are not limited or interfered with by other color ink paths as they are in the conventional example.

The first ink path 101*d* and the second ink path 101*e* are each branched laterally symmetrically with the ink introduction holes 101*a* and 101*b* as a center. Portions of ink paths other than those branched and connected to the ink supply ports (i.e., ink distribution chambers constituting the unbranched portions of the ink paths upstream of the branched portions) are wider in cross section than the ink paths 201*d* and 201*f* shown in FIG. 11. That is, in the ink paths upstream of the first ink path 101*d* and second ink path 101*e* there are formed the ink distribution chambers 107*a*, 107*b* of relatively large cross sections and volumes. This construction stabilizes the ink supply performance and minimizes a possibility of bubbles if accumulated, clogging the ink paths. Especially when bubbles are small, they have little effect on the ink supply performance if they accumulate in some degree. This gives rise to a possibility of being able to significantly reduce the number of recovery operations required to suck out bubbles and even eventually eliminate the recovery operation itself. Therefore, the amount of ink discharged by the recovery operation can be reduced, which in turn provides an ink jet print head with low running cost and high printing throughput.

Further, since the ink supply port 103*c* at the center of the ink ejection member 103 can be directly supplied an ink from the central third ink tank 106*c* without using a winding ink path, the ink supply structure has a high ink supply performance and also the advantage that bubbles do not accumulate easily and, if they accumulate, can easily be removed by the suction-based recovery operation.

Figure 6:
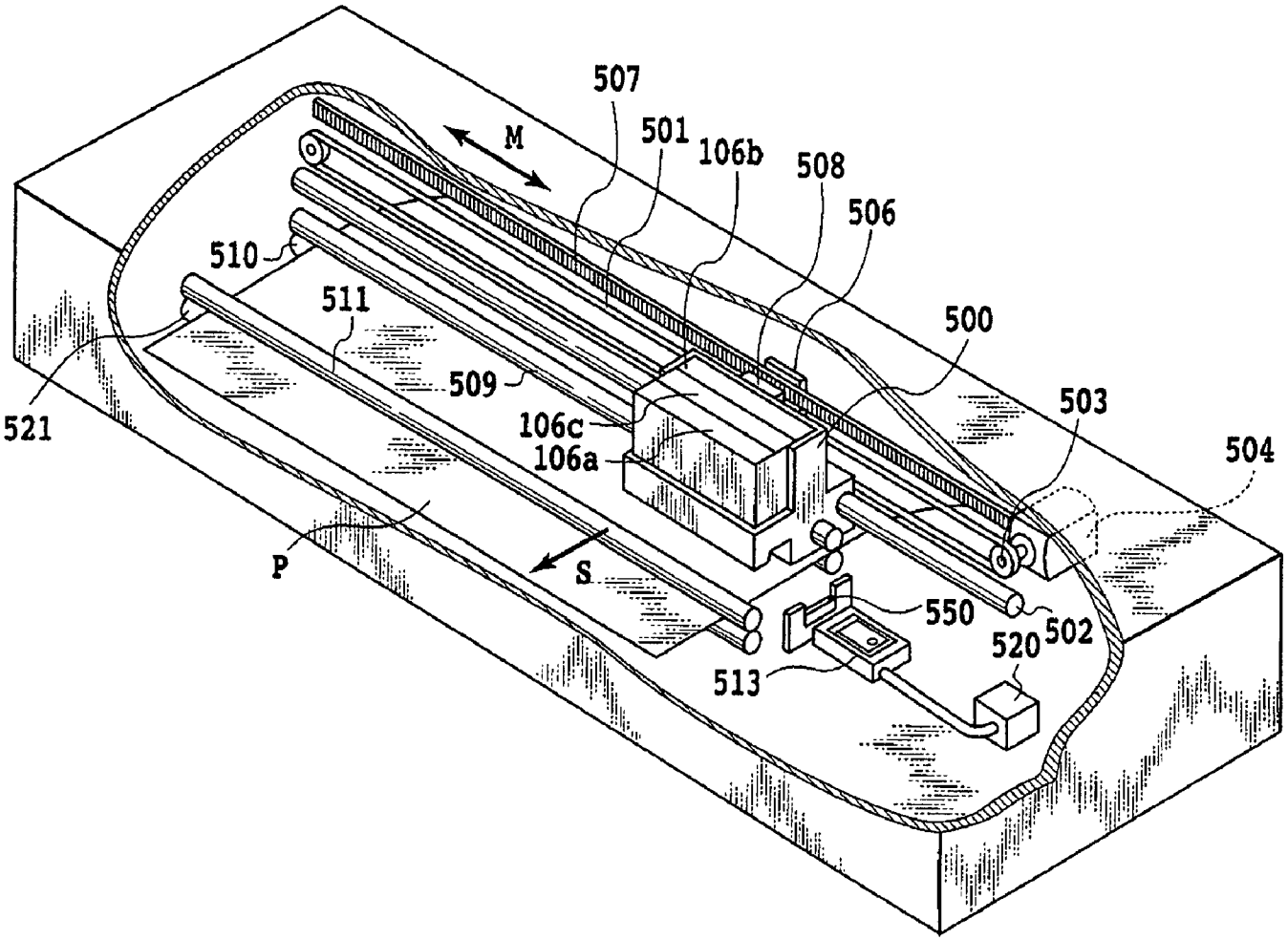
FIG. 6 is a schematic perspective view showing an example construction of an ink jet printing apparatus that uses the ink jet print head of the first embodiment.

FIG. 6 is a schematic perspective view showing an example construction of an ink jet printing apparatus using the ink jet print head described above.

In the printing apparatus shown, a carriage 500 is secured to an endless belt 501 and movable along a guide shaft 502. The endless belt 501 is wound around a pair of pulleys 503 installed at ends of a main scan area, with one pulley 503 coupled to a drive shaft of a carriage drive motor 504. Thus the carriage 500 is reciprocally moved along the guide shaft 502 in a main scan direction (indicated by M) as the motor 504 is operated. On the carriage 500 are mounted the ink jet print head and ink tanks 106*a*, 106*b* and 106*c* containing different color inks used. In this arrangement, a control on the printing operation can be performed by which one and the same order of application of color inks can be used in forming an image on a print medium both during the first main scan in the forward direction and during the second main scan in the backward direction. As a result, color deviations can be suppressed and a good print quality obtained. Here, in this embodiment, the two ink ejection opening columns that eject the same color inks are supplied the inks through the ink paths of the same shapes and dimensions. Therefore, equal ink supply performances can be obtained, whichever of the two ejection opening columns is used, so that the print qualities produced by the first main scan and the second main scan can be made uniform.

Further, in the printing apparatus shown, a linear encoder 506 is installed to detect the position of the carriage in the main scan direction. The linear encoder 506 has as one constitutional element a linear scale 507 extending in the direction of movement of the carriage 500 and having slits formed therein at equal intervals of predetermined density. As another constitutional element the linear encoder 506 has a slit detection system 508, for example, that has a light emitting portion and a light receiving sensor, and a signal processing circuit both provided on the carriage 500. Thus, as the carriage 500 moves, the linear encoder 506 outputs a signal that defines an ink ejection timing and information on the carriage position.

Print paper P as a print medium is intermittently fed in the direction of arrow S perpendicular to the scan direction of the carriage 500. The print paper P is supported by a pair of roller units 509, 510 installed on an upstream side in the transport direction and by a pair of roller units 511, 521 on a downstream side. The Print paper P as a print medium is intermittently fed in the direction of arrow S perpendicular to the scan direction of the carriage 500. The print paper P is supported by a pair of roller units 509, 510 installed on an upstream side in the transport direction and by a pair of roller units 511, 521 on a downstream side. The print paper is given a predetermined tension to maintain a flat surface facing an ejection face, provided with the ejection opening columns, of the ink jet print head (not shown) as it is transported. A force to drive these roller units is transmitted from a paper transport motor (not shown).

With the above construction, as the carriage 500 is moved, the printing over a height of the main scan area corresponding to the length of each of the ejection opening columns of the ink jet print head is repetitively alternated with the feeding of the print paper P until the entire page of the print paper P is printed.

The carriage 500 stops at a home position at the start of printing or during printing as necessary. At this home position there is a cap member 513 that caps the ejection face of the ink jet print head. The cap member 513 is connected with a suction pump 520 that forcibly sucks out ink from the ejection openings to prevent their clogging. At this home position a wiping member 550 is also installed vertically movable to wipe the ejection face of the print head.

Second Embodiment

In the first embodiment, the ink jet print head having removably mounted ink tanks, or ink storage portions, has been explained. The present invention is not limited to the construction of the first embodiment but can employ various other constructions. For example, this invention may be applied to an ink jet print head with integrally formed ink storage portions. That is, the ink jet print head may have unseparably integrated ink tanks. This construction will be explained as the second embodiment of this invention.

Figure 7:
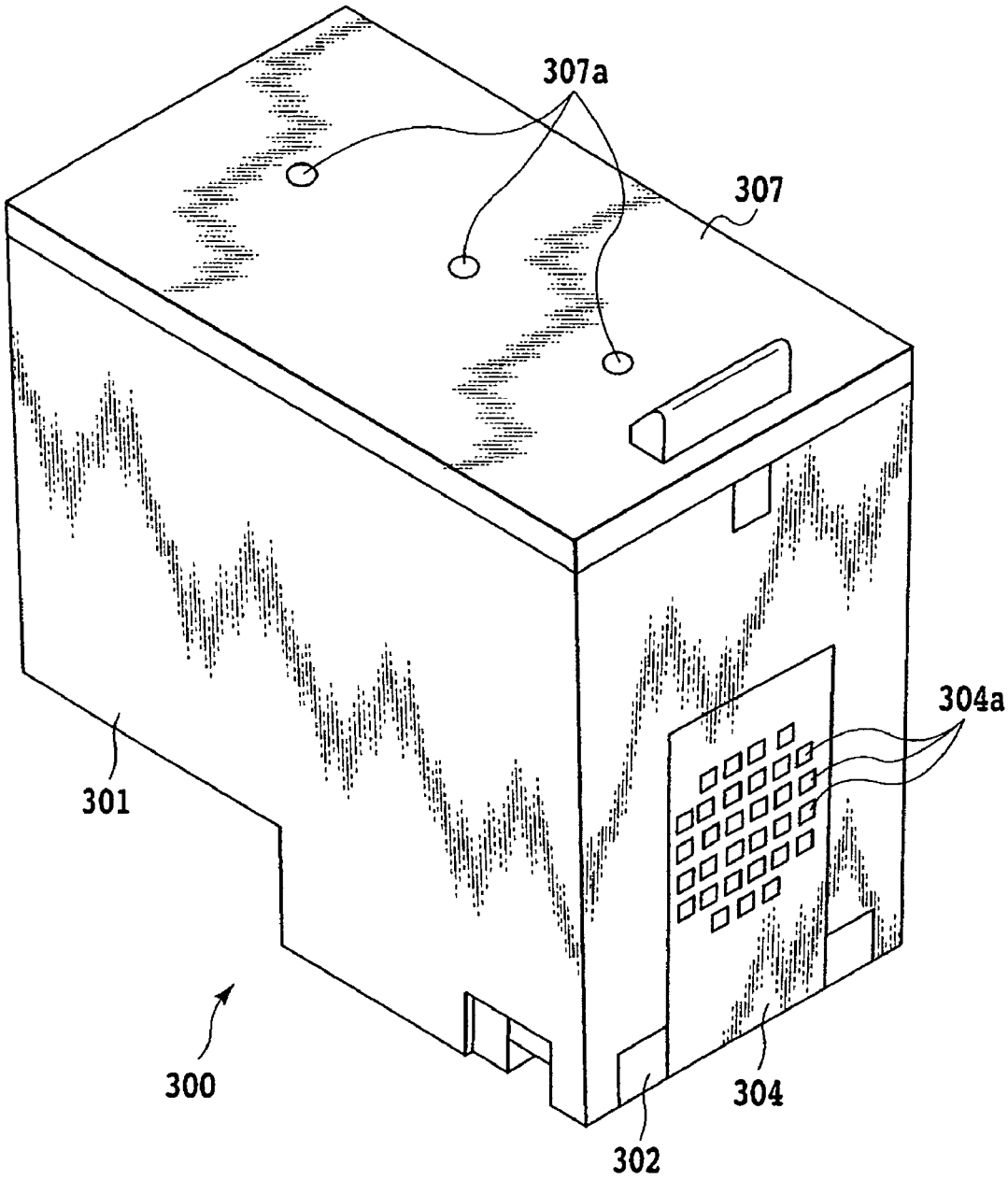
FIG. 7 is a perspective view of a whole ink jet print head of a second embodiment of this invention as viewed from an electric wiring member side.
Figure 8:
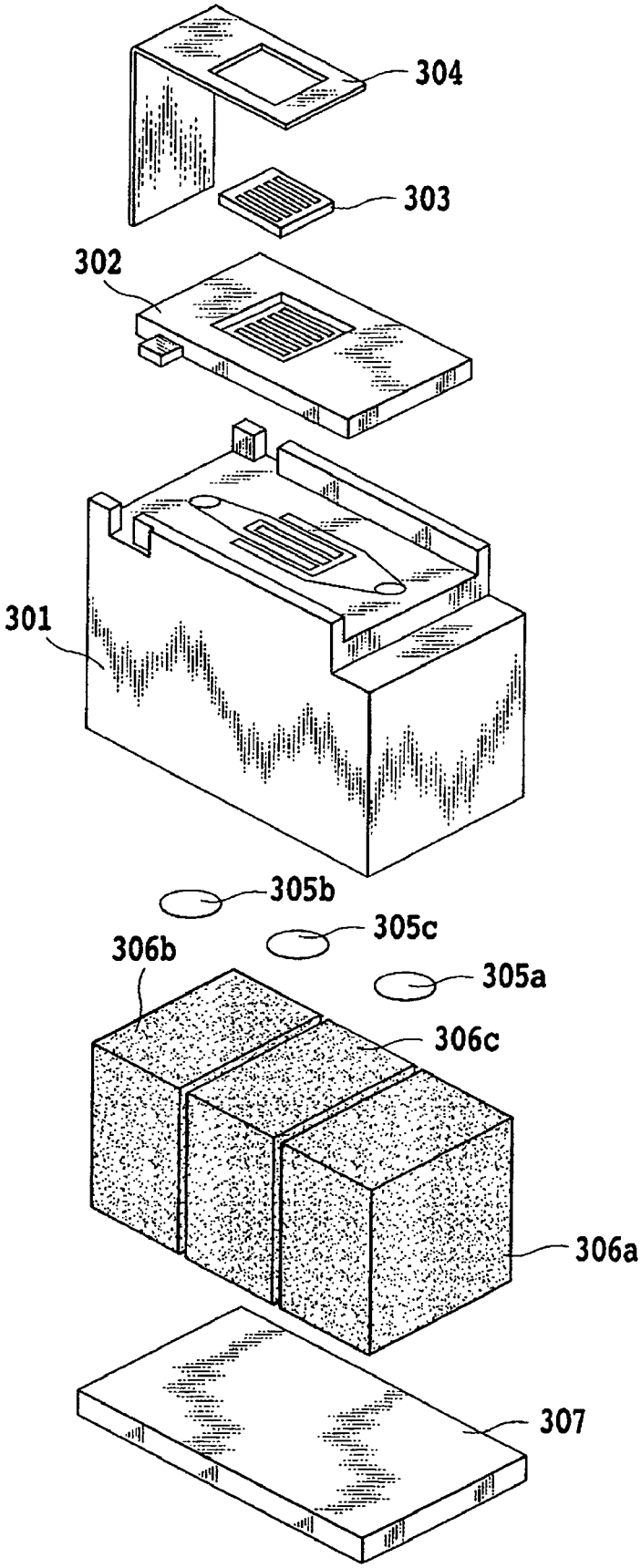
FIG. 8 is an exploded perspective view of the whole ink jet print head of the second embodiment of this invention.
Figure 9:
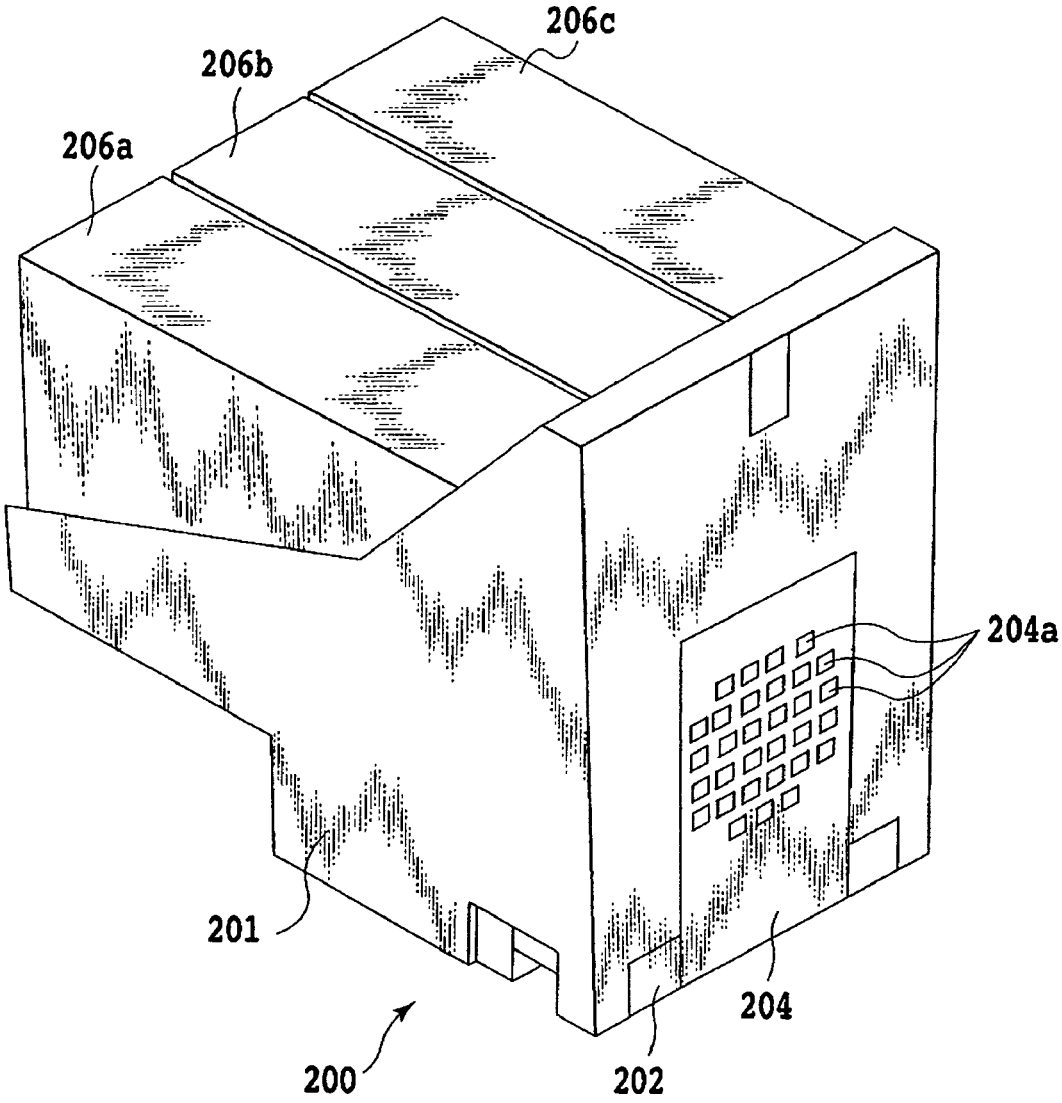
FIG. 9 is a perspective view of a whole, conventional ink jet print head as seen from an electric wiring member side.
Figure 10:
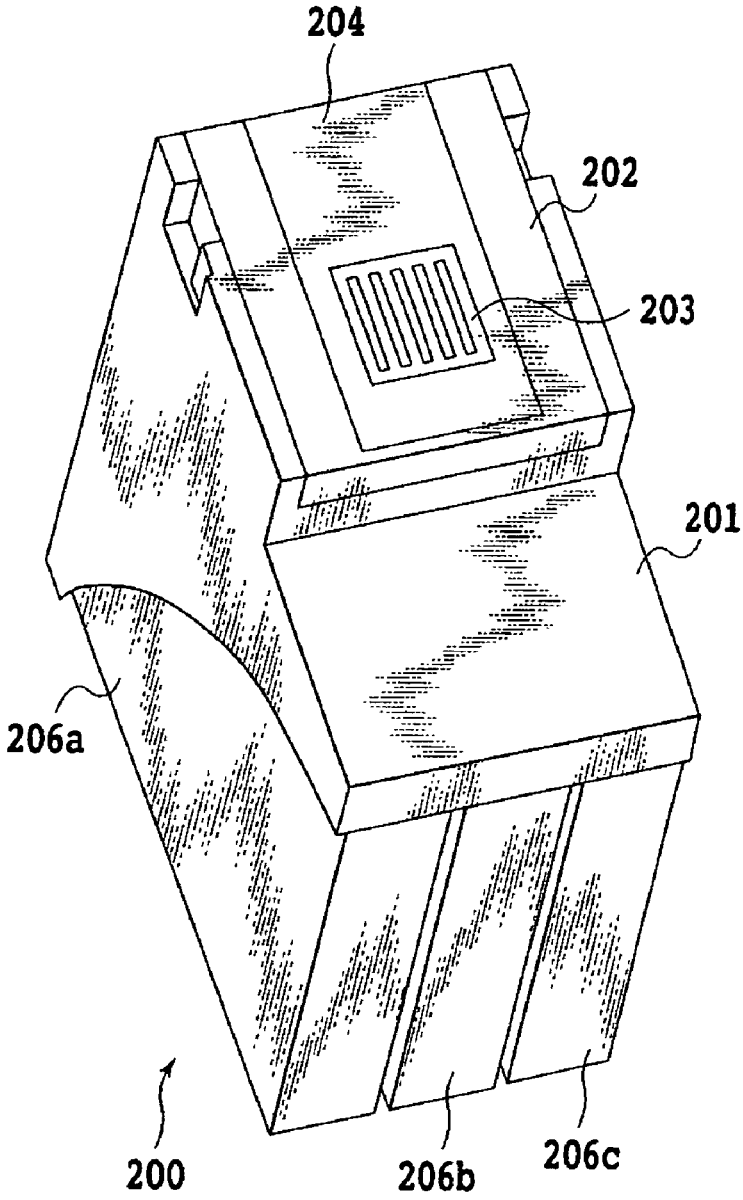
FIG. 10 is a perspective view of the whole, conventional ink jet print head as seen from an ink ejection member side.

FIG. 7 and FIG. 8 show an ink jet print head as the second embodiment of this invention. Here, FIG. 7 is a perspective view of the ink jet print head as a whole, as seen from an electric wiring member side. FIG. 8 is an exploded perspective view of the ink jet print head.

As shown in FIG. 7 and FIG. 8, the ink jet print head 300 of this embodiment comprises an ink ejection member 303, an electric wiring member 304, a flow path plate 302, an ink tank frame 301 and ink storage portions. The electric wiring member 304 has a contact pad 304*a* which is connected to the ink ejection member 303 and receives an electric signal from the ink jet printing apparatus. The ink storage portions comprise first, second and third absorbers 306*a*, 306*b*, 306*c* installed in ink accommodation spaces formed in the ink tank frame 301 to soak and hold ink, a tank cover 307 and air opening 307*a* for introducing air into the ink accommodation spaces as the ink is consumed. In the ink paths there are inserted first, second and third filters 305*a*, 305*b*, 305*c*.

The configuration and construction of the ink paths to supply ink from the ink accommodation spaces in the ink tank frame 301 to the ink ejection member 303 are similar to those described in connection with the first embodiment. So, similar effects can be produced also in this embodiment. But the construction of the ink paths of this embodiment can produce more of its effect when applied to the ink jet print head 300 with integrated ink tanks. That is, the ink jet print head formed integral with the ink tanks is often applied to relatively small, low- cost printing apparatus and, from the standpoint of cost reduction, the amount of ink injected into the print head is usually kept at a minimum required level. Further, the ink jet printing apparatus on which such a print head is mounted often has a very simple recovery mechanism. Therefore, the construction of the ink paths of this embodiment is especially suited for minimizing the amount of ink discharged, by efficiently executing the recovery operation to remove bubbles accumulated in the ink paths for smooth ink supply.

(Others)

In the first and second embodiments, the thee color inks are provided with dedicated ink tanks. Of the three, two color inks are each provided with two ejection opening columns. As for the positional order of colors, explanations were given of the ink jet print head with five (n) ejection opening columns arrayed symmetrically (the number of ink storage portions and the number of ink introduction holes are (n1)/2 =3). It is noted that the kinds of inks can be chosen as one sees fit.

For example, three primary colors of subtractive color mixing system—cyan, magenta and yellow—may be used. Other colors such as black may be added. In addition to using different colors, the inks of the same color may be differentiated in density. That is, the word tone referred to in this specification is a concept including not only color but also density. The number of ejection opening columns can also be determined appropriately according to the number of tones.

Further, adopting an odd number of ejection opening columns and arranging them in a symmetrical order of colors can make the order of color ink application during the first main scan in the forward direction equal to that during the second main scan in the backward direction. This suppresses color deviation, improving the print quality. This invention, however, adopts a construction that simplifies the ink path configuration to make it difficult for bubbles to accumulate and, if they accumulate, make them easily removable by the suction-based recovery operation. Therefore, this invention does not exclude a construction that uses other than the odd number of ejection opening columns.

The preceding examples have described the ink jet print head using electrothermal transducers that generate a thermal energy to heat ink to produce bubbles as they are energized. The ink jet print head may also use piezoelectric elements that apply a mechanical energy to the ink as they are energized.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications.

This application claims priority from Japanese Patent Application Nos. 2005-132316 filed Apr. 28, 2005 and 2006-045786 filed Feb. 22, 2006, which are hereby incorporated by reference herein.

What is claimed is:

1. An ink jet print head comprising:

a plurality of ejection opening columns which can be supplied with ink from a plurality of ink storage portions and which is greater in number than the ink storage portions, wherein at least two of the ejection opening columns that do not adjoin each other in a direction of array of the ejection opening columns can be supplied ink from one of the ink storage portions;

an ink ejection member having the plurality of ejection opening columns and a plurality of ink supply ports, the ink supply ports being arrayed in one-to-one coffespondence with the ejection opening columns to supply ink to the associated ejection opening columns; and a flow path forming member mounted on a surface of the ink ejection member opposite the surface on which the plurality of ejection opening columns is disposed, the flow path forming member being formed with ink introduction holes to introduce ink from the plurality of ink storage portions and with ink paths to communicate the ink introduction holes to the ink supply ports, wherein the plurality of ink introduction holes in the flow path forming member and the plurality of ink supply ports in the ink ejection member are affanged to cross each other three-dimensionally, wherein the ink paths connecting the ink introduction holes and the corresponding ink supply ports are formed so as not to overlap other ink supply ports, wherein the plurality of ink storage portions are equal in number to a plurality of different tones of ink, and at least one of the plurality of tones is provided with at least two sets of the ejection opening columns and the ink supply ports, and wherein the numbers of ejection opening columns and of ink supply ports are each an odd number n which is at least five and the numbers of ink storage portions and of ink introduction holes are each (n1)/2.

2. An ink jet print head comprising:

a plurality of ejection opening columns which can be supplied with ink from a plurality of ink storage portions and which is greater in number than the ink storage portions, wherein at least two of the ejection opening columns that do not adjoin each other in a direction of array of the ejection opening columns can be supplied ink from one of the ink storage portions;

an ink ejection member having the plurality of ejection opening columns and a plurality of ink supply ports, the ink supply ports being arrayed in one-to-one correspondence with the ejection opening columns to supply ink to the associated ejection opening columns; and a flow path forming member mounted on a surface of the ink ejection member opposite the surface on which the plurality of ejection opening columns is disposed, the flow path forming member being formed with ink introduction holes to introduce ink from the plurality of ink storage portions and with ink paths to communicate the ink introduction holes to the ink supply ports, wherein the plurality of ink introduction holes in the flow path forming member and the plurality of ink supply ports in the ink ejection member are arranged to cross each other three-dimensionally, wherein the ink paths connecting the ink introduction holes and the corresponding ink supply ports are formed so as not to overlap other ink supply ports, wherein the plurality of ink storage portions are equal in number to a plurality of different tones of ink, and at least one of the plurality of tones is provided with at least two sets of the ejection opening columns and the ink supply ports, wherein at least two of the ink paths communicating with the ink supply ports are provided for a portion of the tones, and branch laterally symmetrically from the ink introduction holes, and wherein an ink distribution chamber to accumulate ink introduced from the ink introduction holes is provided at a portion where the ink paths are branched.

* * * * *